United States Patent [19]

Ellis

[11] 4,348,973

[45] Sep. 14, 1982

[54] MOTION TRANSFER APPARATUS FOR USE IN SELF STEERING APPARATUS FOR BOATS

[76] Inventor: Brian A. J. Ellis, 62 Hilton Rd., Mapperley, Nottingham, England

[21] Appl. No.: 99,445

[22] Filed: Dec. 3, 1979

Related U.S. Application Data

[63] Continuation-in-part of Ser. No. 872,523, Jan. 26, 1978, abandoned.

[30] Foreign Application Priority Data

Feb. 2, 1977 [GB] United Kingdom ..... 4275/77

[51] Int. Cl.[3] ..... B63H 25/04

[52] U.S. Cl. ..... 114/144 C; 74/99 R

[58] Field of Search ..... 114/144 C, 144 R, 162; 74/99 R

[56] References Cited

FOREIGN PATENT DOCUMENTS 1326020 8/1973 United Kingdom ..... 114/144 C

*Primary Examiner*—Sherman D. Basinger

*Attorney, Agent, or Firm*—Alan H. Levine

[57] ABSTRACT

Self steering apparatus for a boat comprising a motion transfer apparatus for converting pivotal movement of a wind vane into rotational movement of a rudder. The latter is located in a support which is pivotable about the fore and aft axis of the boat. A rotatable connection is provided between a control arm arranged for movement with the vane and a rudder arm arranged for movement with the rudder, such that, when movement of the vane is initiated, there is resultant movement of the rudder arm about the fore and aft axis with movement of the rudder about its axis, and subsequent movement by the water of the rudder support about the fore and aft axis, and movement of the control arm is effected on initial movement of the rudder about its axis but does not result from movement of the rudder support about the fore and aft axis. Lines transmit movement of the rudder support about the fore and aft axis to the main rudder or tiller of the boat.

5 Claims, 3 Drawing Figures

MOTION TRANSFER APPARATUS FOR USE IN SELF STEERING APPARATUS FOR BOATS

This application is a continuation-in-part of copending application Ser. No. 872,523 filed Jan. 26, 1978, now abandoned.

This invention relates to motion transfer apparatus particularly when incorporated in a wind controlled apparatus for use in a sailing boat, so as to automatically control the angular position of a rudder of the boat depending on any angle created between the apparent wind direction and the fore and aft axis of the boat. This wind controlled apparatus is commonly referred to as self steering apparatus.

In certain types of previously proposed self steering apparatus, the rudder and its shaft are arranged to rotate about a first axis on movement of a wind vane, and also the rudder and its shaft can swing in a vertical plane about a substantially horizontal fore and aft due to the action of the water on the rudder as the latter changes position resulting from the movement of the wind vane.

It is an essential and well known feature for the operational stability of this type of steering apparatus that as the rudder swings about the horizontal fore and aft axis under the influence of the water flow, the angle of incidence between the water flow and the rudder should be reduced to prevent continued overcorrection of the boat's course by the steering apparatus.

In one particular known form of apparatus of this type, the transmission between the wind vane and the rudder includes an arm having a cylindrical end portion which is engaged in a slot in a rudder arm, the latter being rigidly secured to the rudder shaft at the upper end and extending radially and upwardly from the rudder shaft. The slot is straight when viewed axially of the rudder shaft and extends through the rudder axis. This arrangement suffers from two main disadvantages. Firstly, considerable wear of the cylindrical end portion takes place as movement is transmitted to the rudder due to the lateral tilting of the cylindrical end portion in the slot, and also the required longitudinal movement of the end portion in the slot to accommodate the rotational movement of the rudder arm. Secondly, when the rudder swings to one side about the horizontal fore and aft axis under the influence of the water flow, it will be apparent that any sudden change of position of the boat in the water which may force the rudder to swing about the horizontal fore and aft axis in the other direction will undesirably transmit such movement through the control arrangement. Also, either the slot has to be long enough to accommodate the resultant travel of the pin, which is not really practicable, or damage to the control arrangement will result.

It is an object of the present invention to provide a novel mechanism which fulfills the requirements of such types of self steering apparatus and yet does not suffer from the disadvantages such as outlined above.

According to the present invention there is provided motion transfer apparatus comprising a first movable member, a second member rotatable within a support about a first axis, and transmission means for converting movement of said first member to rotational movement of said second member about said first axis, said transmission means comprising a control arrangement having a first part which, on movement of said first member, is rotatable about a second axis intersecting said first axis, and a second part which is connected to the said second member to be pivotable relative thereto about a third axis, said first, second and third axes being orthogonal and intersecting with one another at the same point, said first part having means defining a bore extending on a fourth axis which is at an angle to said second axis and which passes through the intersection of the first, second and third axes, and said second part being at least partly located in said bore to be rotatable about the axis of the bore, the support being pivotable about said second axis, such that said second part rotates with said first part about said second axis on initial movement of said first member, and effects resultant movement of said second member about said first axis, and rotation of said first part about said second axis is effected on initial movement of said second member about said first axis, movement of said second member and the support together about said second axis having substantially no effect on said first part movement.

According to the present invention there is also provided self steering apparatus for a boat, said apparatus comprising a wind vane, a rudder, a shaft which mounts said rudder and which is rotatable within a support about a first axis, and transmission means for converting pivotal movement of the vane into rotational movement of the rudder and its shaft about said first axis, said transmission means comprising a control arrangement having a first part which, on movement of the vane is rotatable about a second axis intersecting said first axis, and a second part which is connected to the rudder shaft to be pivotable relative thereto about a third axis, said first, second and third axes being orthogonal and intersecting with one another at the same point, said first part having means defining a bore extending on a fourth axis which is at an angle to said second axis and which passes through the intersection of the first, second and third axes, and said second part being at least partly located in the said bore to be rotatable about the axis of the bore, the support being pivotable about said second axis, such that said second part rotates with said first part about said second axis on initial movement of the vane and effect resultant movement of the rudder about said first axis, and rotation of said first part about said second axis is effected on initial movement of said rudder about said first axis, movement of said rudder and the support together about said second axis having substantially no effect on said first part movement.

An embodiment of the present invention will now be described by way of example only with reference to the accompanying drawings, in which.

Figure 1:
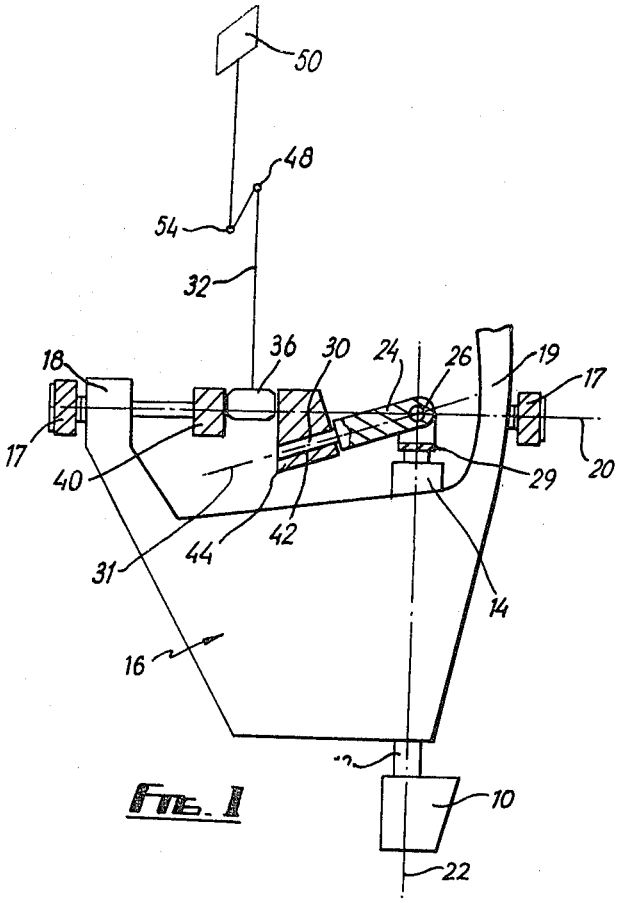
FIG. 1 is a schematic representation in elevation and partial section along line A—A of FIG. 2 of a self steering apparatus according to the invention.

A self steering apparatus for a boat as shown in the drawings comprises a rudder 10 secured at one end a rudder shaft 12, the latter being housed in a tubular member 14 which constitutes part of a rudder support 16. The latter is of substantially U-shaped configuration and is mounted within a horizontally located yoke frame 17 for pivotal movement about a horizontal axis 20. The rudder support 16 is mounted on the frame 17 by means of its legs 18, 19 through suitable bearings, for example PTFE bearings. The apparatus is arranged to be mounted on the stern of a boat by means comprising a first pair of heavy duty tubular struts 21 slidably located in through bores in laterally extending parts 23 of the frame 17. The struts 21 are lockable in any position within the bores and terminate in twist-jointed mounting pads 21*a* which can be flush mounted on almost any surface. The mounting means further comprises a pair of heavy duty lower tubular struts 25 hingedly mounted on lugs 27 extending downwardly from respective ones of the parts 23 of the frame 17, the struts 25 also terminating in twist-jointed mounting pads (not shown). The apparatus is mounted such that the axis 20 is parallel to the fore and aft axis of the boat and the rudder support 16 is capable of swinging in a verticle plane about the axis 20. The rudder shaft 12 is rotatable relative to the member 14 about its axis 22.

At the end of the rudder shaft 12 remote from the rudder 10 a bush 24 is rotatably mounted about an axis 28 on a pin 26, which extends between legs 27 of a U-shaped member 29 mounted on the shaft 12 for rotation with the latter, the axes 20, 22 and 28 being orthogonal and intersecting one another at the same point. The bush 24 mounts a pin 30 which extends forwardly and radially of the axis 28 on an axis 31 and defines a second part or rudder arm, of a transmission arrangement. The axis 31 of the pin 30 passes through the intersection of the axes 20, 22 and 28.

Figure 2:
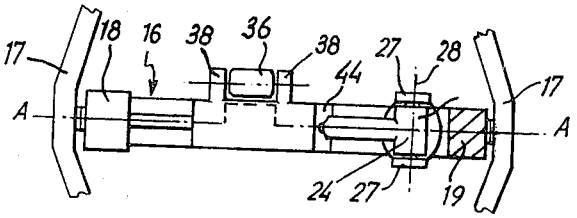
FIG. 2 is a schematic partial plan view of the apparatus of FIG. 1.
Figure 3:
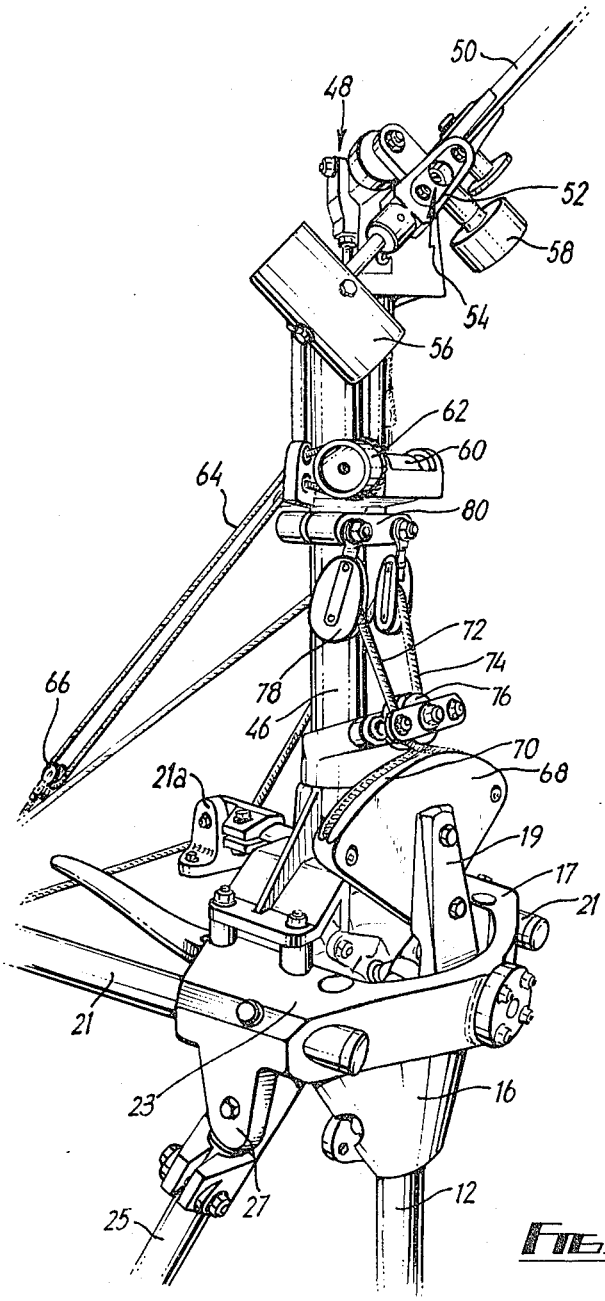
FIG. 3 is a perspective view of one embodiment of a self steering apparatus according to the invention.

The transmission arrangement interconnects the pin or rudder arm 30 with a wind vane assembly which is shown in detail in FIG. 3 but only schematically in FIGS. 1 and 2. The wind vane assembly comprises a connecting rod 32 having its lower end connecting with a bush 36 which is rotatably mounted between flanges 38 extending radially from a control arm 40, the latter defining a first part of the control arrangement. The control arm 40 is rotatable on the axis 20 and rotatably receives the pin or rudder arm 30 in a bore 42 which is defined by a radially extending part 44. At its upper end the connecting rod 32, which extends through a tubular housing 46 fixed relative to the frame 17, has a pivotal connection 48 with a support assembly for a wind vane 50. The vane 50 is releasably secured to a mounting 52 which has a pivotal connection 54 with the support assembly, such that pivotal movement of the mounting 52 and the vane 50 about the horizontal axis of the connection 54 creates vertical movement of the connecting rod 32 by means of the pivot connection 48. This movement of the control rod 32 effects rotation of the control arm 44 and the movement is transmitted to the rudder. A balance weight 56 is provided on the vane support assembly for the vane 50, while a balance weight 58 is also provided on the vane support assembly for the connecting rod 32. The angular disposition of the rudder arm determines the ratio of movement of the angular displacement of the wind to the resulting displacement of the rudder.

For adjustment of the wind vane position, the vane support assembly is mounted for rotation relative to the tubular housing 46 for the control rod 32. To effect the adjustment, the vane support assembly includes a gear wheel (not shown) surrounding the housing 46 and being engaged by a worm 60 which is fixedly mounted relative to the housing 46 and has a drive pulley 62 at one end controlled by an endless line 64 from any convenient position. Preferably the line 64 is run over an end block 66 strung on a shock cord to maintain tension.

For transmitting movement of the rudder assembly to a main rudder or tiller the leg 19 of the rudder housing 16 is upwardly extended to mount a quadrant shaped component 68. The latter has on its upper arcuate periphery a pair of parallel guide slots 70 and at each end of the component 68 there is fixed an end of a respective control line 72, 74. A further guide comprises a pair of adjacent coaxial rollers 76 freely rotatable and fixed in position relative to the frame 17 on an axis extending upwardly and rearwardly of the housing 46 above the axis 20, each of the control lines 72, 74 passing round a respective one of the rollers 76 at the opposite side from the others and being directed over a free running pulley 78 suspended above the rollers 76 from a support collar 80 fixed relative to the housing 46. The arrangement is such that movement of the rudder about the axis 20 in either direction effects movement of a respective one of the control lines 72, 74 and the increased length of the respective control line below the rollers 76 is accommodated in the respective one of the grooves 70. In this way the size of the components 68 is reduced as otherwise it would be necessary to provide an arcuate periphery of twice the length to accommodate the control lines 74, 76.

When the boat is on a predetermined course, the wind vane 50 is arranged to be parallel to the wind direction and remains in a substantially vertical position until there is a change of wind direction such as caused by movement of the boat from its predetermined course. The wind vane 50 then pivots about its horizontal axis and this pivotal movement is transmitted to the rudder 10 which pivots in a direction such as to counteract the movement off course.

As the boat is moving through the water the rudder 10, now being at an angle of incidence to the water flow, is subjected to a force which swings the rudder support 16 with the rudder 10 in the vertical plane about the axis 20. During such movement the rudder 10 is also caused to pivot about the axis 22 in the opposite direction of rotation to that induced by the movement of the vane and the pivoting movement continues until the rudder 10 is moved substantially once again into the plane of the rudder support 16 even though the vane is still deflected from a vertical position. Because of the rotatable connection between the rudder arm 30 and the control arm 44, a 45° movement of the control arm 44 enables a 45° movement of the rudder support 16 before the rudder 10 is again moved back into the plane of the latter. The swinging movement is transmitted to the main rudder or tiller of the boat by the control lines 72, 74 to cause the latter to steer the boat to its original course.

The rotatable connection between the rudder arm and the control arm, i.e. the pin 30, is such that any undesired movement of the rudder 10 and its support 16 will create only rotation of the pin 30 in its bore, such that the movement will not be transmitted to the control arm 44 and therefore to the vane assembly. For example, when movement of the rudder 10 and its support 16 takes place in one direction due to movement of the wind vane, a sudden change in the position of the boat in the water may cause the water to force the rudder 10 and its support 16 to the extreme position in the other direction. This has substantially no effect on the control arm 44 and the wind vane assembly such that no undesired forces are transmitted thereto which would cause considerable damage. Also the rotatable connection minimises wear by friction and the connection between the control arm 44 and the rudder arm 30 is always maintained despite movement between extreme positions. It is to be appreciated that with a suitable modification of the frame construction the transmission arrangement is such that with the connecting rod disconnected, rotation through 360° is possible with only limited rotation of the rudder about its axis. Therefore there would be no problem when the rudder is lifted out of the water in that it would not have to be replaced in a particular position, as the rudder will always line up with the boat. To enable hand steering of the rudder 10, or the rudder 10 to be controlled by an automatic pilot, the rudder arm 30 may be releasably housed in the control arm 44 and may be swung out of engagement with the latter such that the transmission from the wind vane is ineffective.

It is envisaged that the motion transfer apparatus has other applications, for example, in a trim tab steering unit.

A self steering apparatus as herein before described is advantageous in that sliding friction is minimised, fewer parts are utilised than previously proposed types, and the apparatus is relatively cheap and easy to manufacture.

I claim:

1. Motion transfer apparatus comprising a first movable member, a second member rotatable within a support about a first axis, and transmission means for converting movement of said first member to rotational movement of said second member about said first axis, said transmission means comprising a control arrangement having a first part which, on movement of said first member, is rotatable about a second axis intersecting said first axis, and a second part which is connected to the said second member to be pivotable relative thereto about a third axis, said first, second and third axes being orthogonal and intersecting with one another at the same point, said first part having means defining a bore extending on a fourth axis which is at an angle to said second axis and which passes through the intersection of the first, second and third axes, and said second part being at least partly located in said bore to be rotatable about the axis of the bore, the support being pivotable about said second axis, such that said second part rotates with said first part about said second axis on initial movement of said first member, and effects resultant movement of said second member about said first axis, and rotation of said first part about said second axis is effected on initial movement of said second member about said first axis, movement of said second member and the support together about said second axis having substantially no effect on said first part movement.

2. Self steering apparatus for a boat, said apparatus comprising a wind vane, a rudder, a shaft which mounts said rudder and which is rotatable within a support about a first axis, and transmission means for converting pivotal movement of the vane into rotational movement of the rudder and its shaft about said first axis, said transmission means comprising a control arrangement having a first part which, on movement of the vane is rotatable about a second axis intersecting said first axis, and a second part which is connected to the rudder shaft to be pivotable relative thereto about a third axis, said first, second and third axes being orthogonal and intersecting with one another at the same point, said first part having means defining a bore extending on a fourth axis which is at an angle to said second axis and which passes through the intersection of the first, second and third axes, and said second part being at least partly located in the said bore to be rotatable about the axis of the bore, the support being pivotable about said second axis, such that said second part rotates with said first part about said second axis on initial movement of the vane and effects resultant movement of the rudder about said first axis, and rotation of said first part about said second axis is effected on initial movement of said rudder about said first axis, movement of said rudder and the support together about said second axis having substantially no effect on said first part movement.

3. Apparatus according to claim 2, wherein the support is mounted on a frame to be pivotable about said second axis, the frame being arranged to be mounted on a boat.

4. Apparatus according to claim 3, wherein said support mounts a component to which lines are connected for transmission of pivotal movement of the support to a steering control arrangement of the boat.

5. Apparatus according to claim 4, wherein said component comprises a quadrant shaped part having an arcuate periphery, said arcuate periphery comprising a pair of parallel guides extending between respective ends, said lines comprising a pair of lines, each of which is connected to a respective one of the ends of said arcuate periphery and is guided by a respective one of said pair of parallel guides to a respective one of a pair of roller guides which are fixed in position relative to said frame at a location substantially above the quadrant shaped part and said second axis, the parallel guides each being such as to accommodate a length of the respective line on maximum movement of the rudder and its support in either direction about said second axis.

* * * * *